US006445280B1

(12) United States Patent
Javadi

(10) Patent No.: US 6,445,280 B1
(45) Date of Patent: Sep. 3, 2002

(54) COMPOSITE MATERIAL SWITCHES

(75) Inventor: Hamid Javadi, La Crescenta, CA (US)

(73) Assignee: The United States of America as represented by the Adminstrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/808,047

(22) Filed: Dec. 28, 2000

Related U.S. Application Data

(62) Division of application No. 08/530,976, filed on Sep. 20, 1995, now abandoned.

(51) Int. Cl.[7] ..... H01C 3/06

(52) U.S. Cl. ..... 338/214; 338/220; 338/216; 338/21; 338/20

(58) Field of Search ..... 338/214, 216, 338/220, 22 R, 20, 21

(56) References Cited

U.S. PATENT DOCUMENTS

| | | | | | |
|---|---|---|---|---|---|
| 3,375,774 | A | | 4/1968 | Fujimora et al. | |
| 3,611,242 | A | * | 10/1971 | Obenhaus | 338/23 |
| 3,886,511 | A | * | 5/1975 | Miyamoto et al. | 337/119 |
| 4,054,940 | A | | 10/1977 | Buchy et al. | |
| 4,065,649 | A | | 12/1977 | Carter et al. | |
| 4,161,816 | A | | 7/1979 | Frano et al. | |
| 4,166,286 | A | | 8/1979 | Boissonnault | |
| 4,166,389 | A | | 9/1979 | Montren | |
| 4,308,448 | A | * | 12/1981 | Beck et al. | 219/552 |
| 4,419,569 | A | * | 12/1983 | Colten | 219/528 |
| 4,506,250 | A | | 3/1985 | Kirby | |
| 4,538,200 | A | | 8/1985 | Shaikh | |
| 4,561,002 | A | | 12/1985 | Chiu | |
| 4,695,404 | A | | 9/1987 | Kwong | |
| 4,707,762 | A | | 11/1987 | Yapoujian | |
| 4,726,991 | A | | 2/1988 | Hyatt et al. | |
| 4,779,162 | A | | 10/1988 | Beitz et al. | |
| 4,801,996 | A | | 1/1989 | Knotts | |
| 4,802,532 | A | | 2/1989 | Dawes et al. | |
| 4,977,357 | A | | 12/1990 | Shrier | |
| 4,992,333 | A | | 2/1991 | Hyatt | |
| 5,007,872 | A | | 4/1991 | Tang | |
| 5,027,101 | A | | 6/1991 | Morrill, Jr. | |
| 5,088,001 | A | | 2/1992 | Yaworski et al. | |
| 5,128,824 | A | | 7/1992 | Yaworski et al. | |
| 5,197,184 | A | | 3/1993 | Crumly et al. | |
| 5,278,535 | A | * | 1/1994 | Xu et al. | 338/20 |
| 5,294,374 | A | * | 3/1994 | Martinez et al. | 252/518 |
| 5,334,800 | A | | 8/1994 | Kenney | |
| 5,412,539 | A | | 5/1995 | Elwell et al. | |
| 5,414,403 | A | * | 5/1995 | Greuter et al. | 338/22 R |
| 5,476,714 | A | * | 12/1995 | Hyatt | 428/402 |
| 5,726,851 | A | * | 3/1998 | Knapp | 361/104 |
| 5,742,223 | A | | 4/1998 | Simendinger, III et al. | |
| 5,858,533 | A | | 1/1999 | Greuter et al. | |

OTHER PUBLICATIONS

Electrical Reliability of Silver Filed Epoxies for Die Attach, by R.L. Opila et al., AT&T Bell Laboratories, Holmdel, NJ, 1985, pp 164–172.

Elusive Die Attach Intermittencies, ISHM '88 Proceedings, by R.E. Lund et al., Unisys Corp., St. Paul, MN, pp. 68–78.

Ablefilm 563, Gardena, CA, Rev. 1/90.

* cited by examiner

*Primary Examiner*—Karl D. Easthom
(74) *Attorney, Agent, or Firm*—John H. Kusmiss

(57) ABSTRACT

A device to protect electronic circuitry from high voltage transients is constructed from a relatively thin piece of conductive composite sandwiched between two conductors so that conduction is through the thickness of the composite piece. The device is based on the discovery that conduction through conductive composite materials in this configuration switches to a high resistance mode when exposed to voltages above a threshold voltage.

15 Claims, 4 Drawing Sheets

COMPOSITE MATERIAL SWITCHES

This application is a divisional application under 37 C.F.R. §1.60 of prior patent application U.S. Ser. No. 08/530,976 filed on Sep. 20, 1995.

ORIGIN OF THE INVENTION

The invention described herein was made in the performance of work under a NASA contract, and is subject to the provisions of Public Law 96-517 (35 U.S.C. §202) in which the Contractor has elected not to retain title.

TECHNICAL FIELD

The present invention is in the field of materials for microelectronics, both integrated and hybrid circuits, and, more particularly, concerns a composite material that exhibits altered conductivity to provide protection for delicate electronic components.

BACKGROUND ART

Common electronic devices are constantly in danger of being exposed to damaging voltage transients. These voltage transients may be present in the electric mains due to staring or stopping of large electric motors or to lightening strikes near power lines or the like. Even static electric discharges following, for example, the shuffling of one's shoes across a carpeted surface, may cause damage to integrated circuits such as those found in personal computers.

Traditionally, fuses have been the mainstay for protecting electrical circuits from damage. A fuse might be considered an archetype of a material showing altered conductivity or nonlinear resistance. At normal power loads a fuse exhibits uniforms high conductivity (low resistance), but at higher power loads, the fuse melts opening the circuit. That is, the fuse's conductivity alters (i.e., shows nonlinear resistance) and permanently changes to a high resistance mode. However, dangerous voltage transients can wreak damage in a few nanoseconds much too short a time for any ordinary fuse to respond. Furthermore, fuses must be replaced before an electronic device can be used again; fuse-like materials that automatically reset themselves are to be much desired.

Fortunately, materials that show extremely rapid alterations in conductivity have been found and can be used to protect electronic circuitry. Materials that show altered conductivity under various conditions are well known in the art of solid state electronics. These materials are mostly semiconductors, since alteration of conductivity forms the basis for virtually all semiconductor electronics. One of the most widely-used materials that shows altered conductivity is a metal oxide "varistor" (MOV). This semiconductor device exhibits extremely high resistance when exposed to relatively low voltages like those of domestic electric supplies (i.e. 120 V). However, this same device rapidly switches to a good conductor when exposed to higher voltages. MOV materials can be custom made allowing a fairly precise choice of the potential "clamp" voltage (the voltage at which the device switches into a conducting mode).

These materials are usually employed as potential parallel pathways between a voltage supply and ground. Under normal conditions the MOV behaves as an insulator, but when a voltage transient exceeds the clamp voltage, the MOV becomes a good conductor and the transient is harmlessly conducted through the MOV to ground. The MOV then rapidly reverts to its nonconducting state until the next voltage transient arrives.

One problem with MOV materials is that they tend to have relatively high capacitance, which results in a longer than optimal switch-over time. This and related problems have been addressed through the production of altered conductivity materials produced from conducting and semiconducting materials suspended in an insulating matrix such as an epoxy plastic. These materials are reported to have superior properties over traditional MOV devices.

U.S. Pat. No. 4,726,991 to Hyatt et al. discloses a mixture of conductive particles (carbonyl nickel, nickel, tantalum carbide, gold, silver, etc.) in the size range of 100 $\mu$m coated with an insulator such as silicon dioxide and mixed with similarly-sized semiconductor particles (doped silicon, selenium, germanium, etc.) and suspended in an insulating binder such as organic polymers like epoxy. This material is reported to have a more rapid response time than MOV devices and can be made with clamping voltages as low as 5 V.

U.S. Pat. No. 4,992,333 to Hyatt discloses another system based on a packed mixture of conducting, semiconducting and insulating particles, all embedded. in a nonconducting matrix material. The materials are similar in nature to the earlier Hyatt et al. patent. In this case, however, the conducting particles are in the 100-$\mu$m range, the semiconducting particles are in the micrometer range, and the insulating particles are in the submicrometer range. The patent also discloses dimensions and packing ratios necessary to achieve particular results. A similar nonlinear resistance material is disclosed in U.S. Pat. No. 4,977,357 to Shrier, which teaches a material formed from conducting particles uniformly dispersed in an insulating binder.

All of the above-mentioned nonlinear resistors show low conductivity at low potentials and high conductivity at higher potentials. Generally, it is believed that these and similar materials operate by means of quantum electron tunneling. That is, they are all arranged with the conducting particles slightly separated so that the materials exhibit high electrical resistance. As higher potentials are imposed across the materials, electrons "tunnel" through the insulator and "jump" from conducting particle to conducting particle, thus causing the material to switch into the high conductance or low resistance mode. As soon as the potential falls, the electrons are no longer sufficiently energetic to "tunnel" so that the material regains its original high resistance.

The drawback with all of the nonlinear resistors discussed heretofore is that they all transition from high resistance at low potential to low resistance at high potential. While this behavior may be ideal for shunting a power supply to ground, it cannot solve all voltage transient problems.

There are also available a number of "repetitive fuses" (such as PolyFuse manufactured by Raychem Corporation of Menlo Park, Calif.); these devices are variable resistors whose resistance greatly increases with increases of temperature. If a circuit draws excess current through one of these devices, the device will increase in temperature. This causes the resistance to increase greatly, thereby cutting off the circuit from the power source. However, such devices are slow acting and unable to provide protection from brief, but damaging, voltage transients.

High impedance signal inputs such as the gates of field effect transistors (FET) and other similar devices remain sensitive to damage by excessive voltages. These devices can be readily damaged by high voltage pulses or even static electric discharges. Even when such inputs are connected to ground by one of the nonlinear resistors already discussed, damage may occur before the nonlinear resistor can change state and shunt the voltage pulse to ground. Further, many hand-held instruments may lack a clear path to ground rendering these protective devices ineffectual. Furthermore, the need for ground shunts may result in excess fabrication cost or may even alter the operation of some circuits. Having the input shunted to ground by each voltage transient may also tend to introduce noise into the circuit. What is needed is a nonlinear resistor that changes stat in the opposite direction; that is, one that conducts at low potentials and rapidly develops high resistance at higher potentials. Such a resistor could be placed in series with the input and effectively cut off the input whenever the signal contained excessively high voltage.

STATEMENT OF THE INVENTION

The present invention is a device to protect electronic circuitry from high voltage transients. The device is constructed from a relatively thin piece of conductive silver epoxy sandwiched between two conductors. The device is based on the discovery that conductive composite materials in this configuration switch to a high resistance mode when exposed to voltages above a threshold voltage.

BRIEF DESCRIPTION OF THE DRAWINGS

The objects and features of the present invention, which are believed to be novel are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

Figure 1:
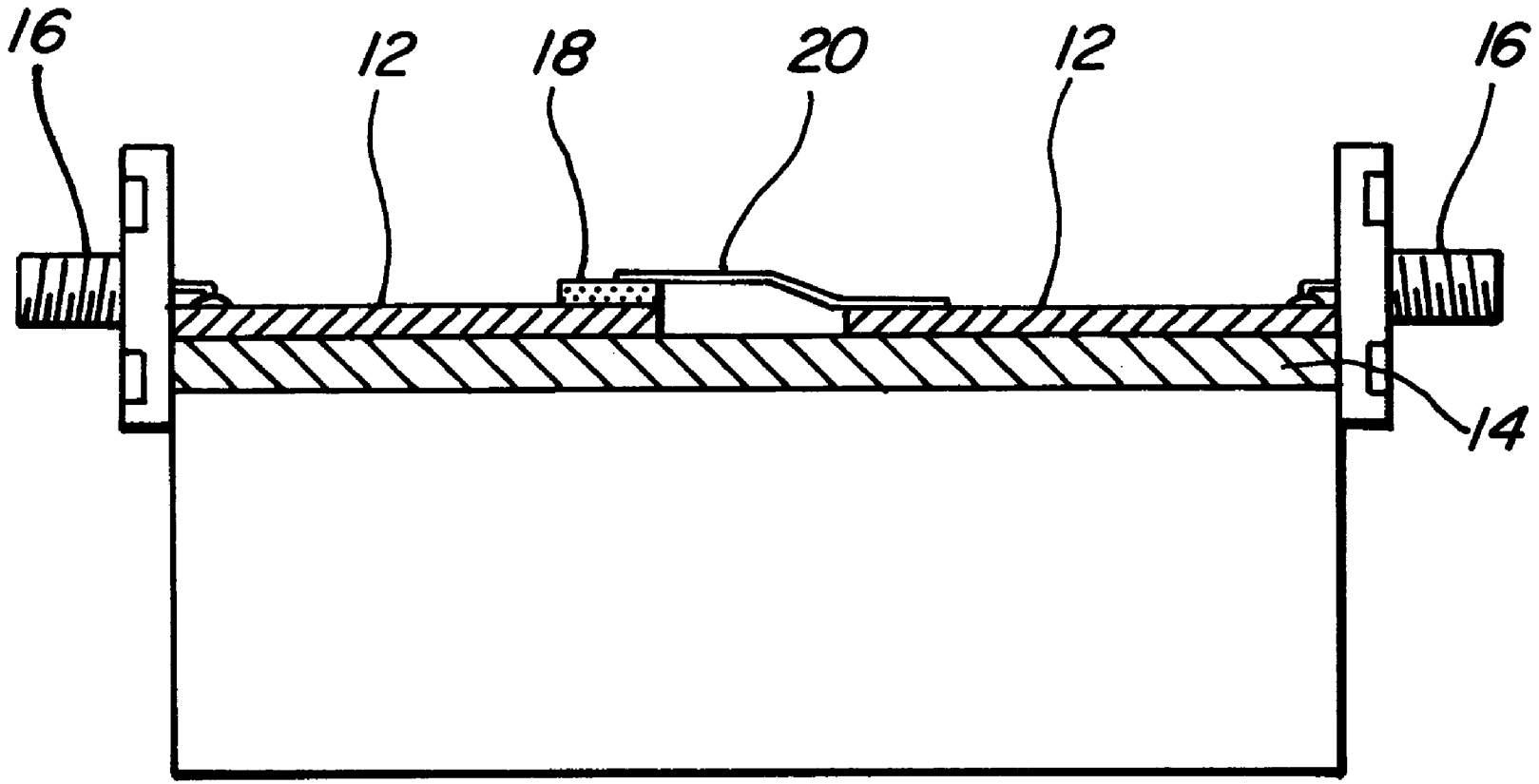
FIG. 1 shows a cross-section of a device constructed with a single silver epoxy preform.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a device consisting essentially of alternating layers of metallic conductors and conductive composite which can protect electronic devices by becoming temporarily nonconductive in the face of increased electrical potential.

Conductive composite materials are well known in the art of integrated circuits and microelectronics. These material consist of metal particles embedded in a background of insulating material. The present inventor has discovered hitherto unknown properties of conductive composite materials in which the concentration of the metal particles is close to percolation threshold. Above the percolation threshold the concentration of the particles is high enough and/or the shape of the particles is such that there is significant particle to particle contact so that conduction will occur directly from particle to particle. Below the threshold the particle concentration is lower and/or the particle shapes preclude significant particle to particle contact and most conduction occurs through the insulating background matrix.

A well-known example is the so-called "silver paint" which is a conductive mixture of silver particles in a liquid vehicle. Such a material can be used to paint or print conductive paths onto circuit boards or other substrates. Silver-filed epoxy is another similar material consisting of an epoxy resin matrix into which a relatively large quantity (generally 50% by weight or greater) of silver particles (flakes, "popcorn," "cigars," or other shapes, depending on design parameters) has been mixed. This material is used as an electrical and/or heat conductive adhesive for affixing components and silicon dies to circuit boards. Besides a liquid paste, silver-filled epoxies are also available as partially cured sheets (preforms) which can be used to lay out conductive traces as well as to attach components to circuit boards.

Although silver-filled epoxies are usually thought of as conductors, they are quite similar in structure to some of the particulate semiconductors discussed above. The epoxy matrix material is an insulating material. While the individual silver particles are metallic conductors, they may be coated by insulating silver compounds such as silver oxide or silver sulfide formed by a reaction of silver metal with the epoxy resin or oxidation by air. Further, depending on the size, shape, and spacing of silver particles, some of the current conduction may occur by means of quantum electron tunneling from silver island to silver island through a sea of epoxy.

There have been a number of reports of conductivity problems or anomalies with silver epoxy composites. A report entitled "Electrical Reliability of Silver Filled Epoxies for Die Attach," Opila, R. and J. D. Sinclair, *IEEE International Reliability Physics Symposium Proceedings*, 164–72 (1985) is typical of these reports. This report addresses the conditions that result in intermittent high resistance, as opposed to desired high conductivity, silver epoxy contacts. The study concludes that conduction in the silver epoxy takes place through a percolative network of silver particles with a combination of contact conduction through the silver particles and quantum tunneling through the epoxy. Further, high resistivity seemed to be mediated by an insulating layer formed around the silver as well as by the orientation of the silver particles at epoxy interfaces.

The present invention was made during a reinvestigation of intermittent silver epoxy conductivity. To limit the variability caused by mixing silver particles with epoxy resin and catalysts a premixed, partially hardened silver epoxy material was used (ECF-563 Ablefilm, Ablestick Co.). This material is available as partially hardened preform sheets of precise thickness (0.003-inch) fabricated by rolling a premixed epoxy. The material is not fully cured and retains considerable stickiness. To attach components to a board, pads and traces are cut from the ECF-563 sheet and pressed onto the board, where they stick firmly. The components are then pressed onto the material and the cure is completed by oven baking. The manufacturer recommends maintaining pressure on the components during the curing process. In the present experiments, the components were too small to readily apply pressure during curing.

Figure 3:
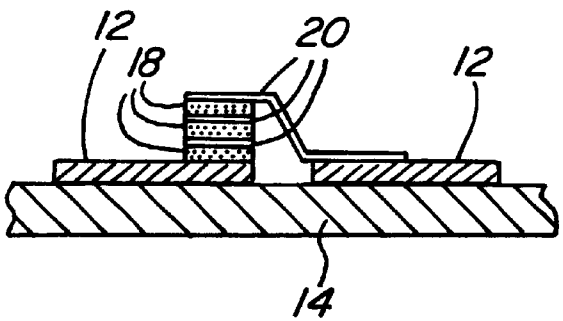
FIG. 3 shows a cross section of the device of FIG. 2.
Figure 2:
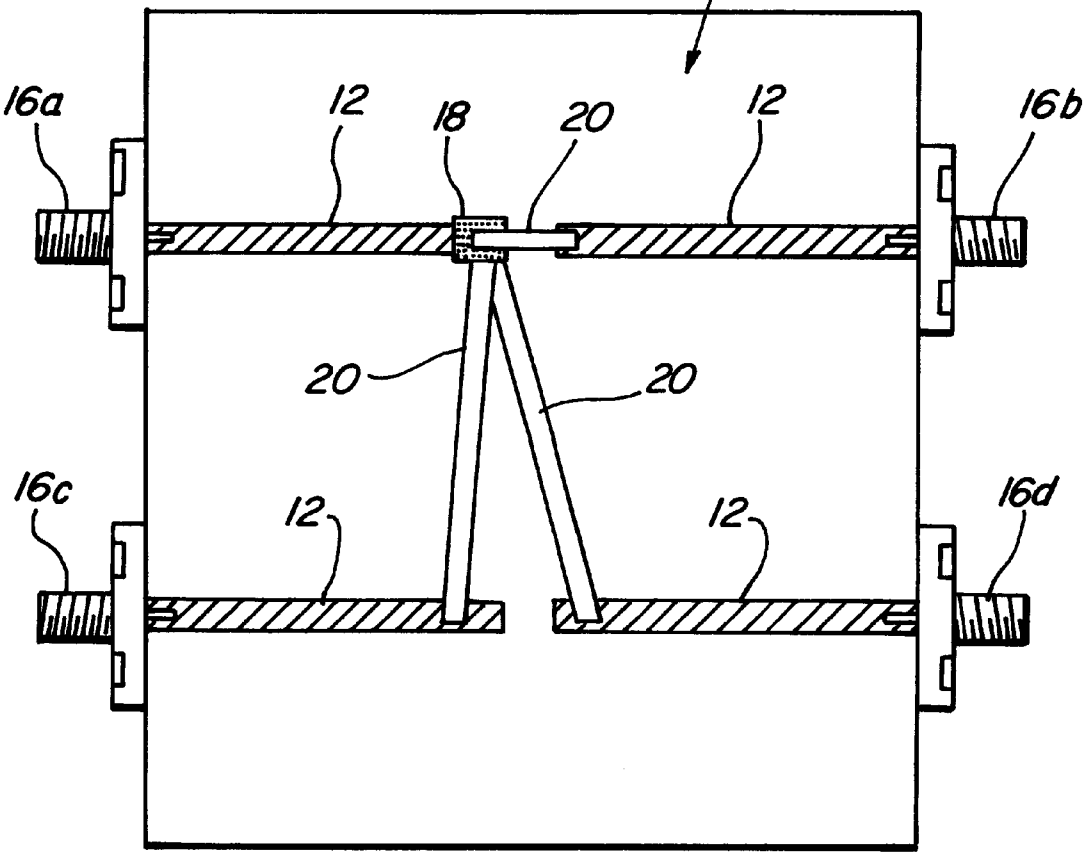
FIG. 2 shows a top view of an experimental device constructed with multiple silver epoxy preforms and used to make precision current-voltage measurements.

For test purposes silver epoxy composite structures shown in FIG. 1 and FIGS. 2 and 3 were constructed. The simplest device, shown in FIG. 3, was used for some resistance measurements and consists of a single-piece silver epoxy preform 18 sandwiched between a gold ribbon 20 and a chromium/copper/gold trace (gold trace) 12 following methods explained below in relation to FIG. 2. The gold traces 12 and ribbons 20 were about 0.025-inch and 0.015-inch wide, respectively, while the pieces of preform 18 were approximately 0.05-inch by 0.05-inch and 0.003-inch thick. This means that electrical conduction was across the thickness of the preforms 18 and was oriented perpendicular to a top and bottom surface of the original preform sheet.

More precise resistance measurements used a four-probe system. As shown in FIG. 2, four gold traces 12 were deposited on an alumina substrate 14. Each of the gold traces 12 was attached at a first end to the connectors 16 which were used to connect voltmeters and other instrumentation. At a second end each gold trace 12 was connected either to a rectangular piece of the silver epoxy preform 18 or to a gold ribbon 20.

The gold ribbons 20 and preform pieces 18 were alternately fastened together to form a laminated structure 22 whose cross-section is shown in FIG. 2. The lamination was accomplished by wiggling and pressing each gold ribbon 20 into one of the preforms 18 with a wooden applicator stick using sufficient pressure to deform but not rupture the surface of the preform 18. Recall that the preform material is not fully cured so it remains tacky. The lamination was then rendered permanent by curing the laminated structure at 125° C. for two hours.

The structure shown in FIGS. 2 and 3 allowed the use of a four-probe resistance measurement methods so that contact resistances would not contribute to the measured value. To make the measurements an alternating current of ±1 $\mu$A was conducted through the device from a first current connector 16*a* to a second current connector 16*b*. The direction of the current was alternated to eliminate the Seebeck effect generated between dissimilar materials in a temperature gradient. At the same time voltage was measured at a first voltage connector 16*c* and a second voltage connector 16*d*. The resistance was obtained by averaging the absolute magnitude of the positive and negative measured voltages divided by the current.

Initial tests of the current-voltage characteristics of the silver epoxy samples were made with a Tektronix 576 curve tracer and revealed intermittent behavior. As the voltage across the sample increased, switching to a high resistive state occurred with the probability of this switching increasing as some threshold voltage was approached.

More precise current-voltage characteristics measurements were then obtained by using a Hewlett Packard 4194A impedance/gain-phase analyzer and a Keithley 237 instrument. These results showed that a sample becomes more resistive when a threshold voltage is exceeded. Further, there is a probability of the sample temporarily returning to a lower resistance before again switching to a higher resistance. As soon as the threshold voltage is removed, the sample returns to a low resistance state. The threshold voltage for one sample varied from 0.4 to 1.9 V in subsequent voltage sweeps: Generally, measured resistance decreased with temperature (from room temperature down to 50° Kelvin), but the effect was slight.

Figure 4:
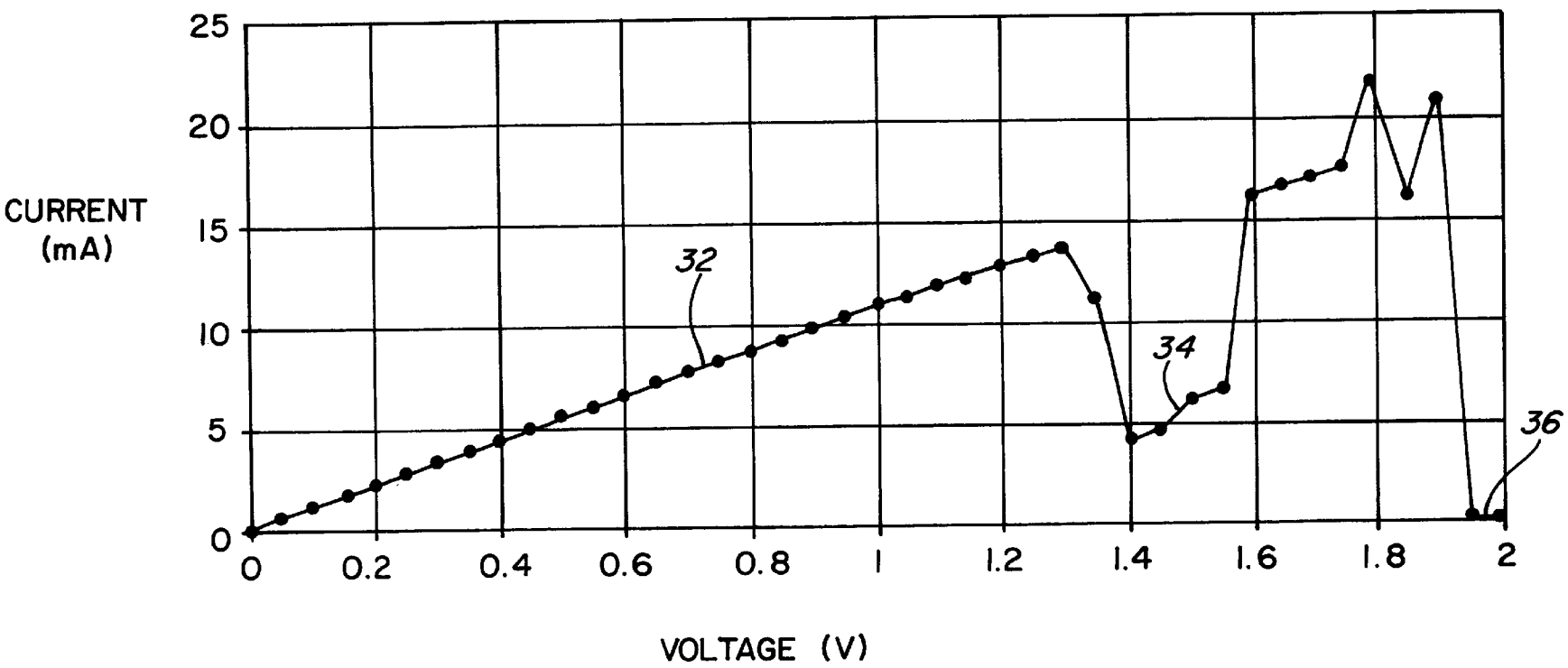
FIG. 4 is a diagram showing current in the silver epoxy device of FIG. 1 at different voltages.

FIG. 4 shows an example of a sample of silver epoxy preform switching to a high resistance state as a result of application of a voltage above the threshold. This sample switched form approximately 200 ohms to greater than 100 megohms. As voltage (x-axis) is increased, a trace 32 shows the current also increasing until there is a current drop 34 indicating a temporary higher resistant at about 1.4 V. After returning to a lower resistance mode, the current shows a precipitous drop 36 to a very high resistance form (>100 megohms). This switching to a high resistive state appears to be a fundamental and inherent feature of these conductive silver epoxies and of similar metal/insulator composites.

Figure 5:
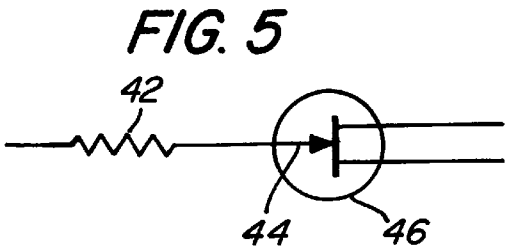
FIG. 5 shows an example of a circuit diagram with the device of the present invention in actual use.

FIG. 5 shows a circuit diagram of a device 42 in a typical application. The device 42 is connected in series with a gate electrode 44 of a field effect transistor (FET) 46. The device is pictured as a resistor, but as explained above, the device's resistance is strongly dependant upon potential above a threshold voltage. The FET gate 44 can be damaged by high voltage transients such as static discharges and is normally protected by built-in clamping diodes (not shown). However, even the diodes may fail to, . adequately protect the gate 44. The device 42 of the present invention provides additional protection by rapid and complete cutting off of the FET 46 from damaging potentials.

The device 42 may represent a single piece of conductive composite 18 or may represent multiple pieces stacked as in FIG. 3 to alter the switching potential or the power handling capacity of the device 42. Depending on the desired result the pieces of composite can be connected in series as in FIG. 3, or the intermediate gold ribbon conductors 20 can be tied to one of the device's inputs resulting in a parallel configuration.

An additional application for the present invention can be found in the fabrication of conducting cables. It should be obvious to those of ordinary skill in the art that epoxy-based and similar flexible conductive composites can be molded to construct virtually any structural feature of conductive cables.

Figure 6:
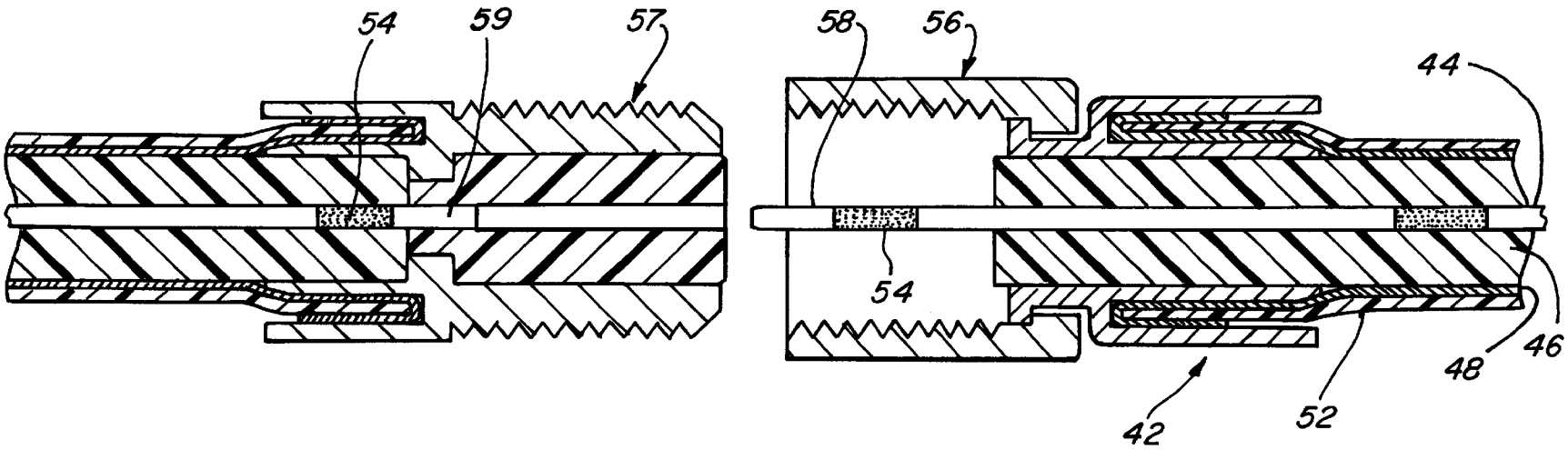
FIG. 6 shows the present invention used as a "fuse link" in a central lead of a coaxial cable, in a central connector pin in a male coaxial connector, and in a central connector socket in a female coaxial connector.

Producing all or part of the central conductor of coaxial cables according to the structures of the present invention would be especially advantageous and well suited. Normally the central conductor is used to deliver relatively low current, low voltage: signals to sensitive electronic components. As shown in FIG. 6, a coaxial cable 42. comprises a central conductor 44, a surrounding insulating separator 46, a coaxial conductor 48 and sheathing insulation 52. By placing a "fuse link" 54 of a suitable conductive composite into the central conductor at some periodic distance one would automatically provide significant protection for vulnerable electronics. The fuse link could be placed every so many feet (say 10 or 100 ft) to ensure that any installation would have at least one fuse link 54.

Alternatively, coaxial connectors 56 (male) and 57 (female) could be fabricated with a central male connector pin 58 and a central female socket 59, respectively, fabricated from the composite conductor or containing a fuse link 54 similar to that in the coaxial cable 42.

Generally direct current conductivity of composite materials has been successfully described by Sheng's model ("Fluctuation-induced tunneling conduction in disordered materials," *Phys. Rev.* B 21: 2180(1980)). Under that model conduction is dominated by electron transfer between metallic islands (charging energy). The overall conduction of the system is limited by tunnel junctions where electrons tunnel through the insulating matrix between the metallic islands. This tunneling is predicted to show a negative temperature coefficient of resistivity (TCR). TCR has long been considered an important distinguisher of conduction mechanisms on both side of the metal-insulator transition with metals having a positive TCR and insulators having a negative TCR. Since the conductive epoxy system described herein shows only a small variation of conductance with temperature, it behaves more like a system on the verge of the metal-insulator transition as opposed to a typical Sheng model composite conductor.

Under the conditions of a metal-insulator transition the presence of localized centers (e.g., charge and spin defects due to broken or "dangling" bonds. radicals, or lone electron pairs) in the insulating matrix (epoxy) or an insulating layer on the metal particles (oxide or sulfide) cannot be ignored. Very high electric fields may be generated between closely spaced metallic islands separated by an organic layer.

Complications in conduction are caused by the presence of weakly localized centers involved in carrier hopping and strongly localized centers leading to space-charge effects in both the epoxy matrix and the metal oxide/sulfide. Where localized centers in the insulating materials mediate conduction between the metallic islands, field distribution caused by space charge effects may be so large as to create a region in the insulator that has an electric field directed against the current leading to a complete switching off of conductivity as seen in the present case.

It must be appreciated that the described silver epoxy conductive composite is used as a model for a general class of composite conductors. Other metals and insulating matrices should give comparable results. Further, this type of device can be fabricated as an integrated circuit by depositing, by sputtering for instance, conductive particles on in a thin insulating layer on a conductive substrate and by then depositing an additional insulating layer over and around the conductive particles and completing the device with a conducting layer. In any case, sandwiching conductive composite material between conductors, as in the illustrated experimental devices, reveals a unique nonlinear resistance property wherein the material rapidly and repeatedly switches to a high, resistance state when exposed to a threshold voltage.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved coaxial cable having a central conductor, an insulator surrounding the central conductor and separating it from a coaxial conductor which is, in turn, sheathed with insulation, the improvement comprising;

fuse links consisting of short lengths of a conductive composite material periodically interrupting the central conductor and forming a conductive bridge between lengths of the central conductor, the conductive composite material comprising a plurality of metallic particles of a concentration approaching a percolation conduction threshold in a background matrix of insulating material, the fuse links serving to prevent conduction of damaging potential through the central conductor thereby protecting sensitive electronic components in electrical communication with the coaxial cable.

2. The improved coaxial cable of claim 1 where the metallic particles are silver.

3. An improved connector for use with a coaxial cable having a central conductor, an insulator surrounding the central conductor and separating it from a coaxial conductor which is, in turn, sheathed with insulation, the improvement comprising;

a fuse link consisting of a short length of a conductive composite material interrupting a central connector of the coaxial connector and forming a conductive bridge, the conductive composite material comprising a plurality of metallic particles of a concentration approaching a percolation conduction threshold in a background matrix of insulating material, the fuse link serving to prevent conduction through the male connector pin of damaging potential from the central conductor thereby protecting sensitive electronic components in electric communication with the coaxial cable.

4. The improved coaxial connector of claim 3, wherein the coaxial connector is a male connector and the fuse link interrupts a central male connecting pin of the coaxial connector.

5. The improved coaxial connector of claim 3, wherein the coaxial connector is a female connector and the fuse link interrupts a central female connecting socket of the coaxial connector.

6. The improved connector of claim 3 where the metallic particles are silver.

7. A coaxial cable comprising:

a central conductor having a plurality of lengths connected by fuse links;

said fuse links forming a conductive bridge between the lengths of the central conductor; said fuse links comprising a conductive composite material having a plurality of metallic particles of a concentration approaching a percolation conduction threshold in a background matrix of insulating material; said fuse links having a first operative mode of conductivity below a predetermined threshold voltage and a second operative mode of increased resistivity at and above a predetermined threshold voltage; and, an insulator surrounding the central conductor separating the central conductor from a coaxial conductor sheathed with a coaxial insulator.

8. The coaxial cable of claim 7 further comprising a central male connecting pin having a fuse link.

9. The coaxial cable of claim 7 further comprising a central female connecting socket interrupted by a fuse link.

10. A male connector for use with a coaxial cable having a central conductor, the connector comprising a coaxial connector surrounding a male connector pin having at least two lengths bridged by a fuse link, said fuse link comprising a conductive composite material having a plurality of metallic particles of a concentration approaching a percolation conduction threshold in a background matrix of insulating material.

11. The connector of claim 10 where the fuse link has a first operative mode of conductivity below a predetermined threshold voltage and a second operative mode of increased resistivity at and above the predetermined threshold voltage.

12. A female connector for use with a coaxial cable having a central conductor, the connector comprising a coaxial connector surrounding a female connecting socket having an end wherein a fuse link connects the end of the female connecting socket to the central conductor of the coaxial cable; said fuse link comprising a conductive composite material having a plurality of metallic particles of a concentration approaching a percolation conduction threshold in a background matrix of insulating material.

13. The connector of claim 10 where the metallic particles are silver.

14. The female connector of claim 12 wherein said fuse link has a first operative mode of conductivity below a predetermined threshold voltage and a second operative mode of increased resistivity at and above the predetermined threshold voltage.

15. The female connector of claim 12 where the metallic particles are silver.

* * * * *